US006453875B1

(12) United States Patent
Mahr et al.

(10) Patent No.: US 6,453,875 B1
(45) Date of Patent: Sep. 24, 2002

(54) FUEL INJECTION SYSTEM WHICH USES A PRESSURE STEP-UP UNIT

(75) Inventors: Bernd Mahr, Plochingen; Martin Kropp, Korntal-Muenchingen; Hans-Christoph Magel, Pfullingen; Wolfgang Otterbach, Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/700,276

(22) PCT Filed: Feb. 29, 2000

(86) PCT No.: PCT/DE00/00580

§ 371 (c)(1),
(2), (4) Date: Feb. 21, 2001

(87) PCT Pub. No.: WO00/55496

PCT Pub. Date: Sep. 21, 2000

(30) Foreign Application Priority Data

Mar. 12, 1999 (DE) ..... 199 10 970

(51) Int. Cl.[7] ..... F02M 7/00
(52) U.S. Cl. ..... 123/446; 123/447
(58) Field of Search ..... 123/502, 456, 123/447, 478, 458, 446, 467, 497

(56) References Cited

U.S. PATENT DOCUMENTS

| | | | | |
|---|---|---|---|---|
| 4,069,800 A | * | 1/1978 | Kanda et al. | 123/447 |
| 4,280,464 A | * | 7/1981 | Kanai et al. | 123/447 |
| 4,333,436 A | * | 6/1982 | Kopse et al. | 123/502 |
| 4,459,959 A | * | 7/1984 | Terada et al. | 123/446 |
| 4,545,352 A | * | 10/1985 | Jourde et al. | 123/447 |
| 4,712,528 A | * | 12/1987 | Schaffitz | |
| 5,497,750 A | * | 3/1996 | Mueller et al. | 123/446 |
| 5,803,028 A | * | 9/1998 | Rose | 123/78 E |

FOREIGN PATENT DOCUMENTS

EP 0056916 A1 * 8/1982

* cited by examiner

*Primary Examiner*—Willis R. Wolfe
*Assistant Examiner*—Mahmoud Gimie
(74) *Attorney, Agent, or Firm*—Ronald E. Greigg

(57) ABSTRACT

A fuel injection system has a pressure step-up unit, disposed between a pressure storage chamber and a nozzle chamber, whose pressure chamber communicates with the nozzle chamber via a pressure line. A bypass line connected to the pressure storage chamber is also provided. The bypass line communicates directly with the pressure line. The bypass line can be used for pressure injection and is disposed parallel to the pressure chamber, so that the bypass line is open regardless of the motion and position of a displaceable piston element in the pressure step-up unit. This enhances the flexibility of injection.

11 Claims, 8 Drawing Sheets

FUEL INJECTION SYSTEM WHICH USES A PRESSURE STEP-UP UNIT

CROSS-REFERENCE TO RELATED APPLICATIONS

This is a 35 USC 371 application of PCT/DE 00/00580 filed on Feb. 29, 2000.

PRIOR ART

The invention relates to a fuel injection system having a pressure step-up unit.

For the sake of better comprehension of the specification and claims, some terms will first be defined: The fuel injection system of the invention can be embodied as either a stroke-controlled or a pressure-controlled fuel injection system. Within the scope of the invention, the term stroke-controlled fuel injection system will be understood to mean that the opening and closing of the injection opening is effected with the aid of a displaceable valve member on the basis of the hydraulic cooperation of the fuel pressures in a nozzle chamber and a control chamber. A pressure reduction inside the control chamber causes a stroke of the valve member. Alternatively, the excursion of the valve member can be effected by a final control element. In a pressure-controlled fuel injection system according to the invention, as a result of the fuel pressure prevailing in the nozzle chamber of an injector, the valve member is moved counter to the action of a closing force spring, so that the injection opening is uncovered for an injection of the fuel out of the nozzle chamber into the cylinder. The pressure at which the fuel emerges from the nozzle chamber into a cylinder of an internal combustion engine is called the injection pressure, while the term system pressure is understood to mean the pressure at which fuel is available or kept on hand inside the fuel injection system. The term fuel metering means the furnishing of a defined fuel quantity for injection. The term leakage is understood to mean a quantity of fuel that occurs in operation of the fuel injection system, for instance a reference leakage which is unused for injection and is returned to the fuel injection system. The pressure level of this leakage can have a static pressure, whereupon the fuel is then depressurized to the pressure level of the fuel injection system.

A stroke-controlled injection has been disclosed for instance by German Patent Disclosure DE 196 19 523 A1. The attainable injection pressure here is limited by the pressure storage chamber (rail) and the high-pressure pump to approximately 1600 to 1800 bar.

To increase the injection pressure, a pressure step-up unit is possible, of the kind disclosed for instance by U.S. Pat. No. 5,143,291 or U.S. Pat. No. 5,522,545. The disadvantage of these pressure-stepped-up systems resides in a lack of flexibility of the injection and poor quantity tolerance in the metering of small fuel quantities.

In a fuel injection system described in Japanese Patent Disclosure JP 08277762 A, two pressure storage chambers with different pressures are provided in order to enhance the flexibility of injection and increase the metering precision of the preinjection. These two pressure storage chambers require major production effort and high production cost, and the maximum injection pressure is still limited by the fuel pump and the pressure storage chamber.

A pressure step-up unit disposed in the injector is known from European Patent Disclosure EP 0 691 471 A1. A bypass line for a pressure injection and a pressure chamber of the pressure step-up unit are in line with one another, so that the bypass line is open only as long as a displaceable piston of the pressure step-up unit is not moved and is completely retracted.

ADVANTAGES OF THE INVENTION

The fuel injection system of the invention enhances the flexibility and increases the maximum injection pressure. Each injector of a common rail system is assigned a hydraulic pressure step-up unit, which enables both increasing the maximum injection pressure to higher pressure, such as greater than 1800 bar, and furnishing a second, higher injection pressure. The bypass line leads at the end of the pressure chamber of the pressure step-up unit into the lead line to the nozzle chamber or into the lead line of the pressure step-up unit to the nozzle chamber. An injection of fuel at lesser pressure can be effected regardless of the position of the pressure means in the pressure step-up unit. By means of the pressure step-up unit, the pressure storage chamber and injector are subjected to a lesser static pressure (rail pressure) and thus have a longer service life. The high-pressure pump also suffers less stress. The possibility exists of a meterable preinjection with low tolerances by means of low (non-stepped-up) injection pressure. By switching over between the injection pressures, a flexible postinjection or a plurality of postinjections at high or low injection pressure are feasible.

BRIEF DESCRIPTION OF THE DRAWINGS

Seven exemplary embodiments of the fuel injection system of the invention are shown in the schematic drawings and are described in the ensuing description. Shown are.

DESCRIPTION OF THE EXEMPLARY EMBODIMENTS

Figure 1:
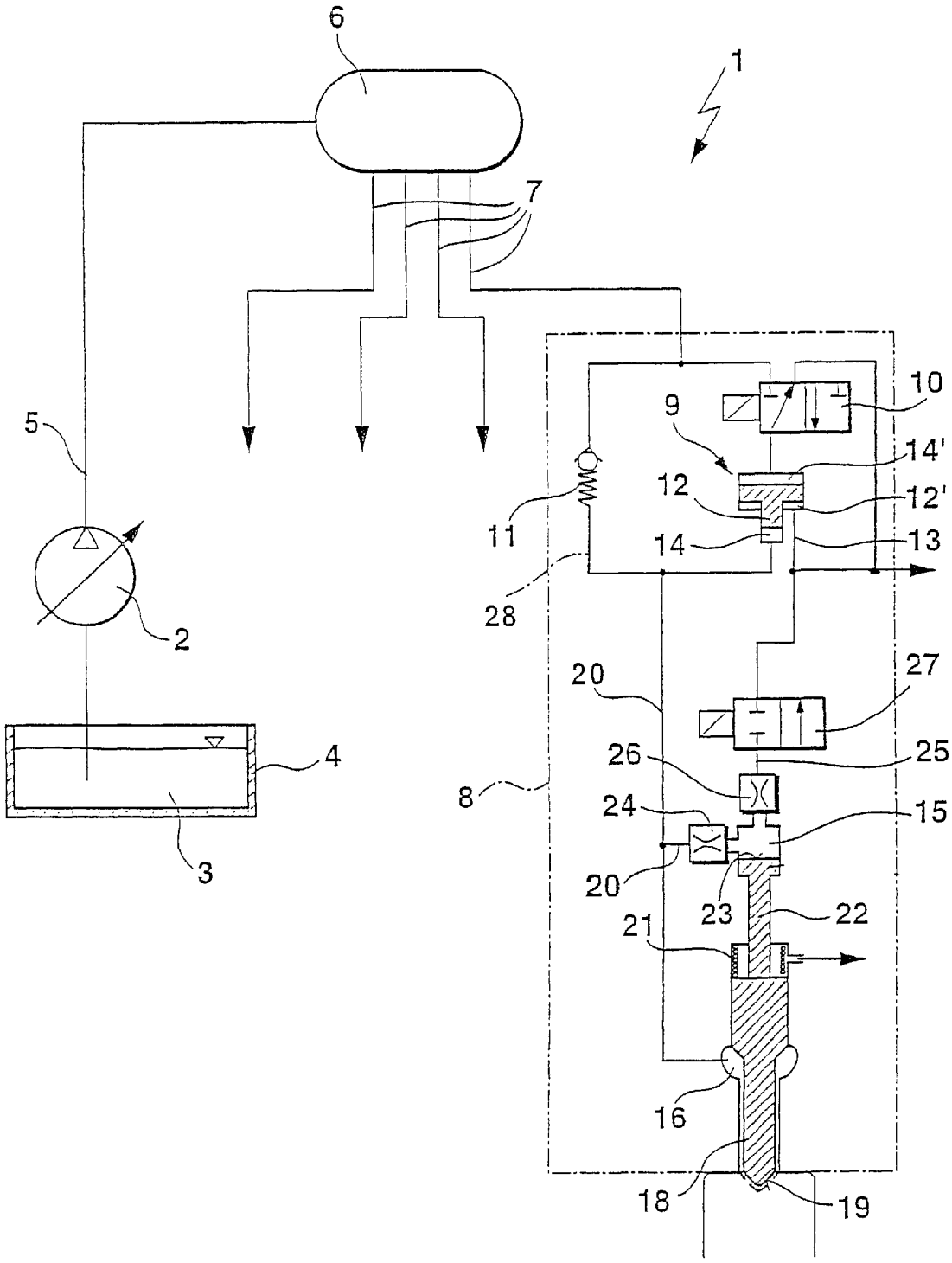
FIGS. 1 and 2 and FIGS. 5 and 6, show stroke-controlled fuel injection systems.

In the first exemplary embodiment, shown in FIG. 1, of a stroke-controlled fuel injection system 1, a quantity-regulated fuel pump 2 pumps fuel 3 out of a tank 4 via a supply line 5 into a central pressure storage chamber 6 (common rail), from which a plurality of pressure lines 7, corresponding in number to the number of individual cylinders, communicate to the individual injectors 8 (injection devices) protruding into the combustion chambers of the internal combustion engine to be supplied. In FIG. 1, only one of the injectors 8 is shown. With the aid of the fuel pump 2, a first system pressure is generated and stored in the pressure storage chamber 6. This first system pressure is used for preinjection and as needed for postinjection (HC enrichment for exhaust gas posttreatment or soot reduction) and for representing an injection course with a plateau, known as boot injection. For injection of fuel with a second, higher system pressure, each injector 8 is assigned a local pressure step-up unit 9, which is located inside an injector 8. The pressure step-up unit 9 includes a valve unit 10 such as a 3/2-way valve for pressure step-up triggering, a check valve 11, and a pressure means 12 in the form of a displaceable piston element. The pressure means 12 can be connected on one end to the pressure line 7 with the aid of the valve unit 10, so that the pressure means 12 can be acted upon by pressure on one end. A differential chamber 12' is pressure-relieved by means of a leakage line 13, so that the pressure means 12 can be displaced in order to reduce the volume of a pressure chamber 14. The pressure means 12 is moved in the compression direction, so that the fuel located in the pressure chamber 14 is compressed and delivered to a control chamber 15 and a nozzle chamber 16. The check valve 11 prevents a return flow of compressed fuel into the pressure storage chamber 6. By means of a suitable ratio of areas in a primary chamber 14' and the pressure chamber 14, a second, higher pressure can be generated. With the aid of the valve unit 10 the primary chamber 14' is connected to the leakage line 13. With proper control, the result is the return of the pressure means 12 and the re-filling of the pressure chamber 14. Because of the pressure ratios in the pressure chamber 14 and the primary chamber 14', the check valve 11 opens, putting the pressure chamber 14 under rail pressure, the pressure of the pressure storage chamber 6, and returning the pressure means 12 hydraulically to its outset position. To improve the return performance, one or more springs can be disposed in the chambers 12, 14 and 14'. By means of the pressure step-up, a second system pressure can thus be generated.

The injection takes place via a fuel metering with the aid of a pistonlike valve member 18, which is axially displaceable in a guide bore and has a conical valve sealing face 19 on one end, that is, the end with which it cooperates with a valve seat face on the injector housing of the injector unit 8. On the valve seat face of the injector housing, injection openings are provided. Inside the nozzle chamber 16, a pressure face pointing in the opening direction of the valve member 18 is subjected to the pressure prevailing there, which is delivered to the nozzle chamber 16 via a pressure line 20. The valve member 18 is also engaged, coaxially with a valve spring 21, and by a pressure piece 22. Pressure piece 22 has one face end 23 remote from the valve sealing face 19 and defines the control chamber 15. From the fuel pressure connection direction, the control chamber 15 has an inlet with a first throttle restriction 24 and an outlet to a pressure relief line 25 with a second throttle restriction 26, which is controlled by a valve 27, such as a 2/2-way valve The nozzle chamber 16 communicates, via an annular gap between the valve member 18 and the guide bore, with the valve seat face of the injector housing. The pressure piece 22 is urged by pressure in the control chamber 15 in the closing direction.

Fuel at the first or second system pressure constantly fills the nozzle chamber 16 and the control chamber 15. Upon proper actuation of the 2/2-way valve 27, the pressure in the control chamber 15 can be decreased, so that as a consequence, the compressive force in the nozzle chamber 16 urging the valve member 18 in the opening direction exceeds the compressive force urging the valve member 18 in the closing direction. The valve sealing face 19 then lifts from the valve seat face, and fuel is injected. The pressure relief operation of the control chamber 15, and thus the stroke control of the valve member 18 can be varied by way of the dimensioning of the throttle restriction 24 and the throttle restriction 26.

The end of the injection is initiated by properly deactuating the 2/2-way valve 27. Which decouples the control chamber from the leakage line 13, so that a pressure that can move the pressure piece 22 in the closing direction builds up again in the control chamber 15.

The valve units are actuated by electromagnets for proper opening or closing. The electromagnets are controlled by a control unit, which is capable of monitoring and processing various operating parameters (engine r.p.m., etc.) of the engine to be supplied.

Instead of the magnet-controlled valve units, piezoelectric control elements (actuators) can also be used. These piezoelectric elements can be designed to possess a requisite temperature compensation and optionally a required step-up of force or travel.

The fuel injection system 1 has the pressure step-up unit 9, disposed between the pressure storage chamber 6 and the nozzle chamber 16, whose pressure chamber 14 communicates with the nozzle chamber 16 via the pressure line 20. A bypass line 28 connected to the pressure storage chamber 6 is also provided. The bypass line 28 communicates directly with the pressure line 20. The bypass line 28 can be used for an injection at rail pressure and is in a fuel circuit which is parallel to the pressure chamber 14, so that the bypass line 28 is open regardless of the motion and position of the displaceable pressure means 12 of the pressure step-up unit 9. This enhances the flexibility of injection.

Below, in the description of FIGS. 2–9, only differences from the fuel injection system of FIG. 1 will be addressed. Identical components will not be described in detail.

Figure 2:
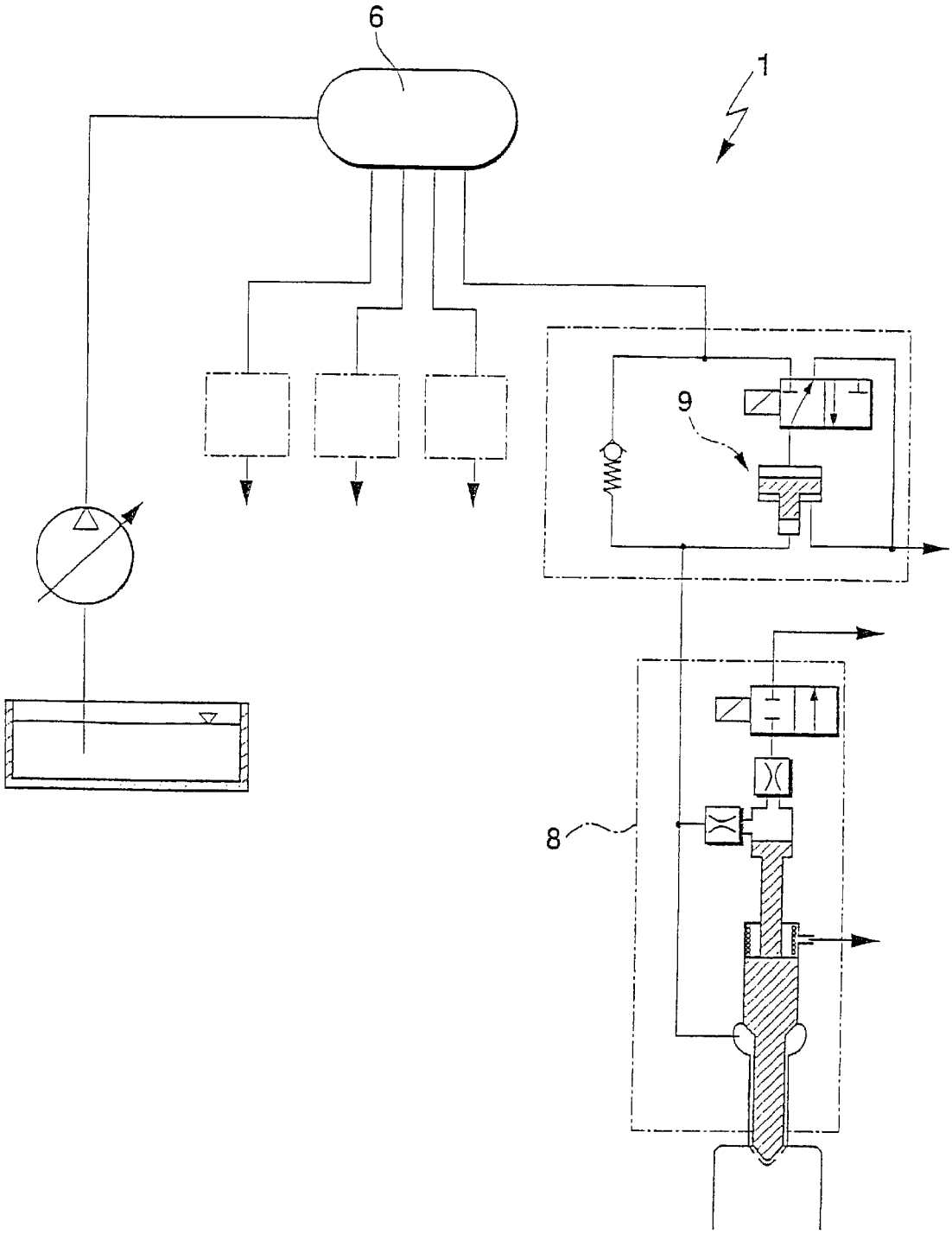

From FIG. 2, it can be seen that the pressure step-up unit 9, in a modification of the fuel injection system 1, is disposed outside the injector 8. This can be an arbitrary point between the pressure storage chamber 6 and the injector 8. The structural size of the injector 8 is less. An integration of the pressure step-up unit 9 with its associated valve assembly and the pressure storage chamber 6 in one component is possible. The valve assembly can also be disposed outside the pressure step-up unit 9.

Figure 3:
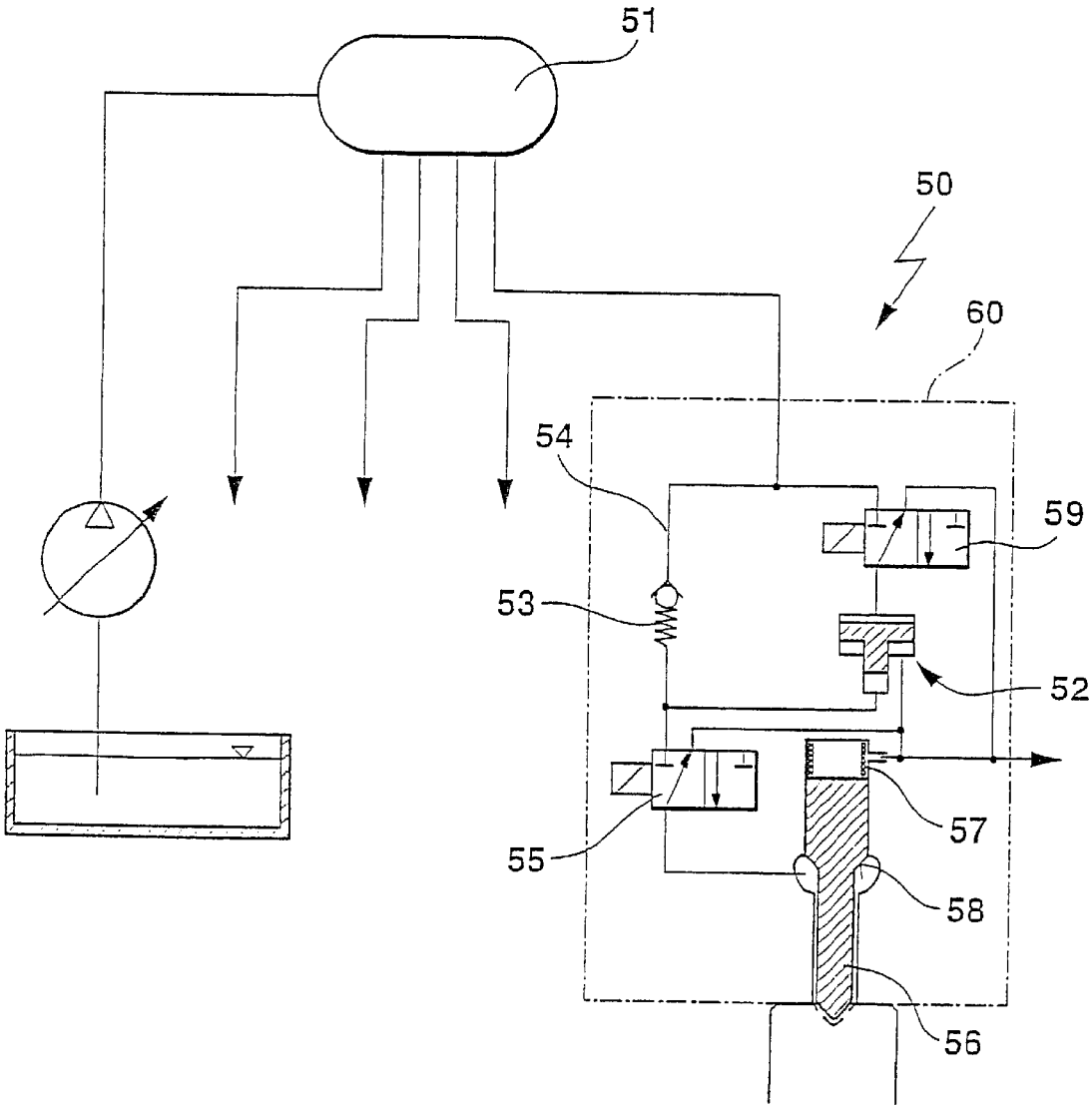
FIGS. 3 and 4 and FIG. 7, show pressure-controlled fuel injection systems.

A fuel injection system 50 of FIG. 3 has a pressure storage chamber 51 for fuel at a first system pressure. A higher system pressure is made possible by a pressure step-up unit 52, which can be added with the aid of the valve unit 59. The pressure-controlled fuel metering is effected via a valve unit 55, such as a 3/2-way valve. An injector valve member 56 can be moved counter to the force of a valve spring 57, if the pressure applied to the pressure faces 58 exceeds the spring force of the valve spring 57. The 3/2-way valves 55 and 59 are located inside an injector 60.

Figure 4:
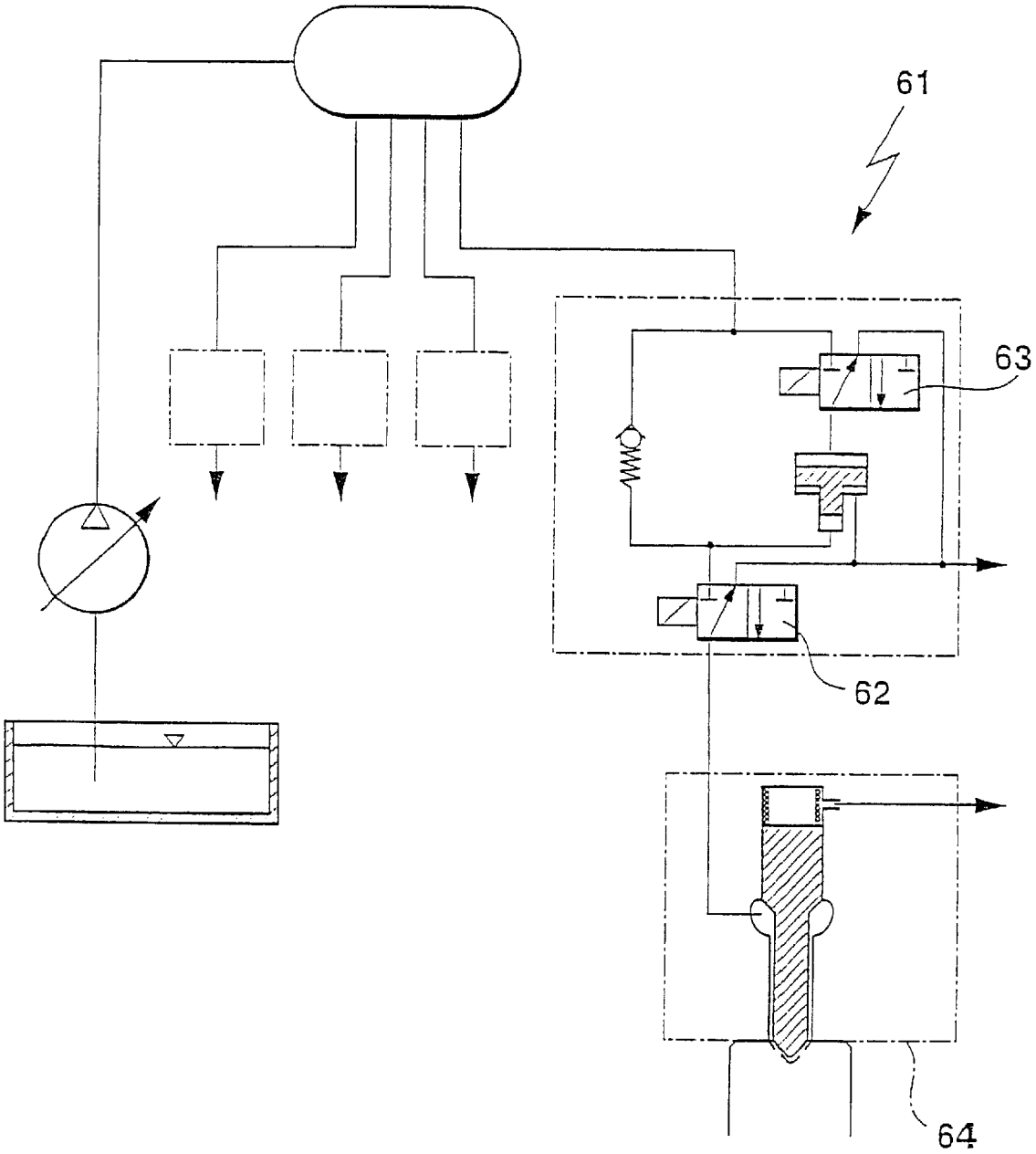

FIG. 4 shows a fuel injection system 61 similar to FIG. 3, whose valve units for fuel metering 62, a 3/2-way valve and for triggering the pressure step-up 63, a 3/2-way valve are disposed outside the injector 64. It is equally possible to dispose the two valves separately from one another in the fuel injection system 61.

Figure 5:
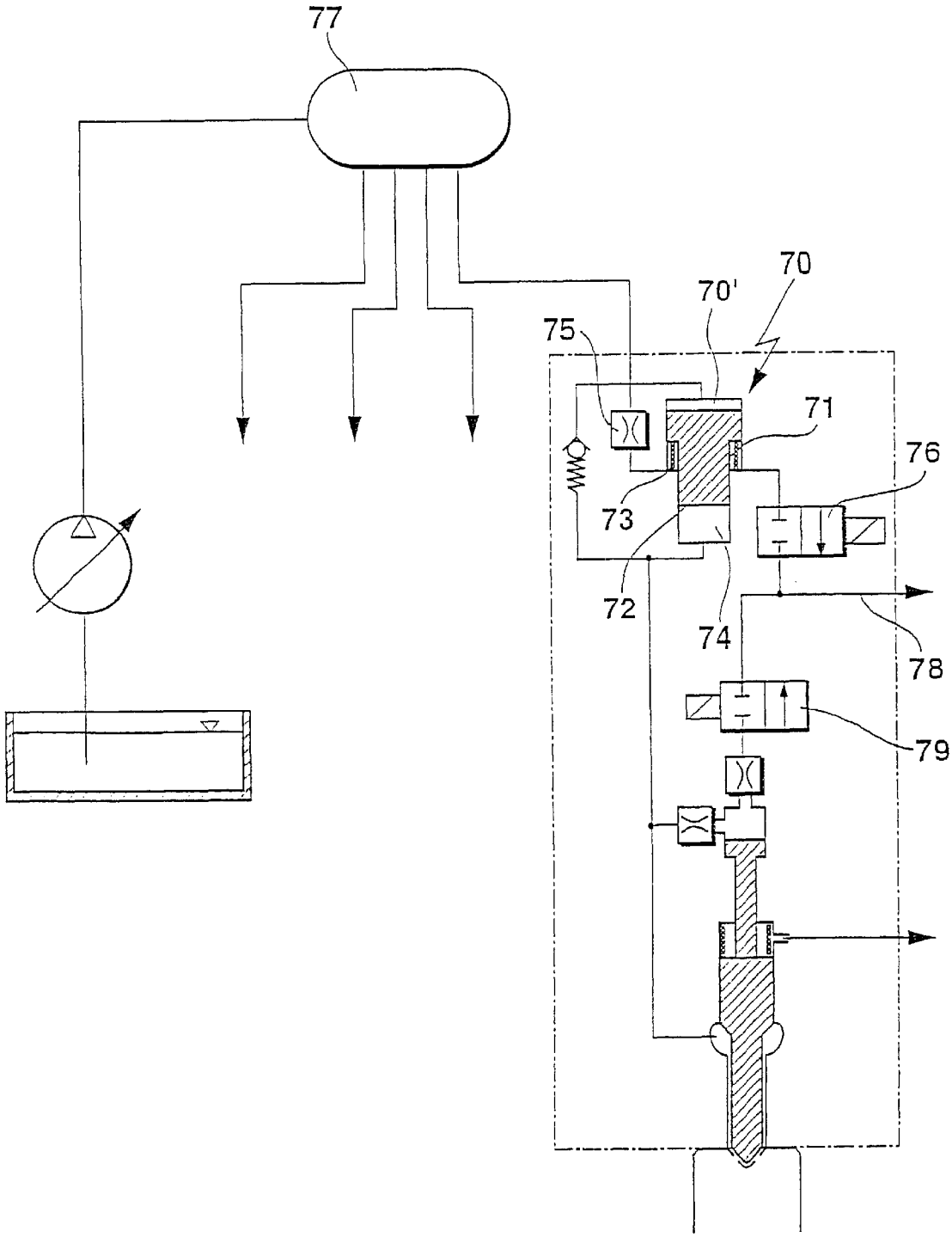

A simplified triggering of a pressure step-up unit 70 which is optimized with regard to loss is shown in FIG. 5. For controlling the pressure step-up unit 70, the pressure in the differential chamber 71, embodied by a transition from a larger to a smaller piston cross section, is employed. For refilling and deactivating the pressure step-up unit, this differential chamber is acted upon by a supply pressure, or rail pressure. Then, the same pressure conditions, rail pressure, prevails at all the pressure faces of a piston 72. The pressure 72 is in pressure equilibrium. By means of an additional spring 73, the piston 72 is forced into its outset position. To activate the pressure step-up unit 70, the differential chamber 71 is pressure-relieved, and the pressure step-up unit generates a pressure boost in accordance with the area ratio. By means of this type of control, it can be seen that for returning the pressure step-up unit 70 and re-filling a pressure chamber 74, there is no necessity of pressure-relieving a large primary chamber 70'. When the hydraulic step-up is small, the depressurizing losses can thus be reduced sharply.

For controlling the pressure step-up unit 70, it is possible instead of a complicated 3/2-way valve to use a throttle restriction 75 and a simple 2/2-way valve 76. The throttle restriction 75 connects the differential chamber 71 with fuel at supply pressure from a pressure storage chamber 77. The 2/2-way valve connects the differential chamber 71 to a leakage line 78. The throttle restriction 75 should be designed to be as small as possible, yet still large enough that the piston 72 returns to its outset position between injection cycles. When the 2/2-way valve 76 is closed, no leakage occurs in the guides of the piston 72, since the differential chamber 71 is subjected to pressure. The throttle restriction can also be integrated with the piston.

If the 2/2-way valves 76 and 79 are closed, then the injector is subject to the pressure of the pressure storage 20 chamber 77. The pressure step-up unit is in its outset position. Now, by means of the valve 79, an injection at rail pressure can be effected. If an injection at a higher pressure is desired, then the 2/2-way valve 76 is opened, and a pressure boost is thus achieved.

Figure 6:
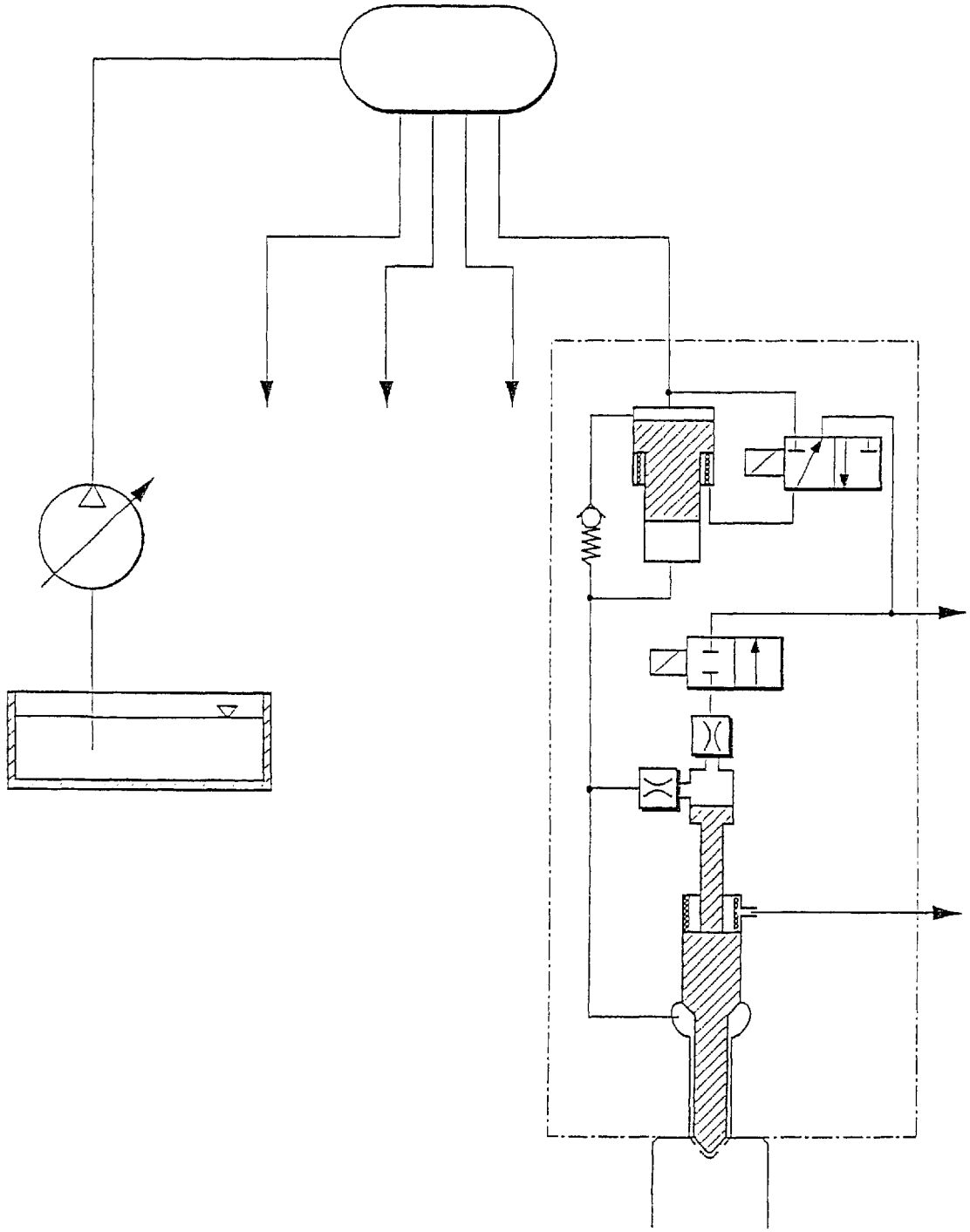
Figure 7:
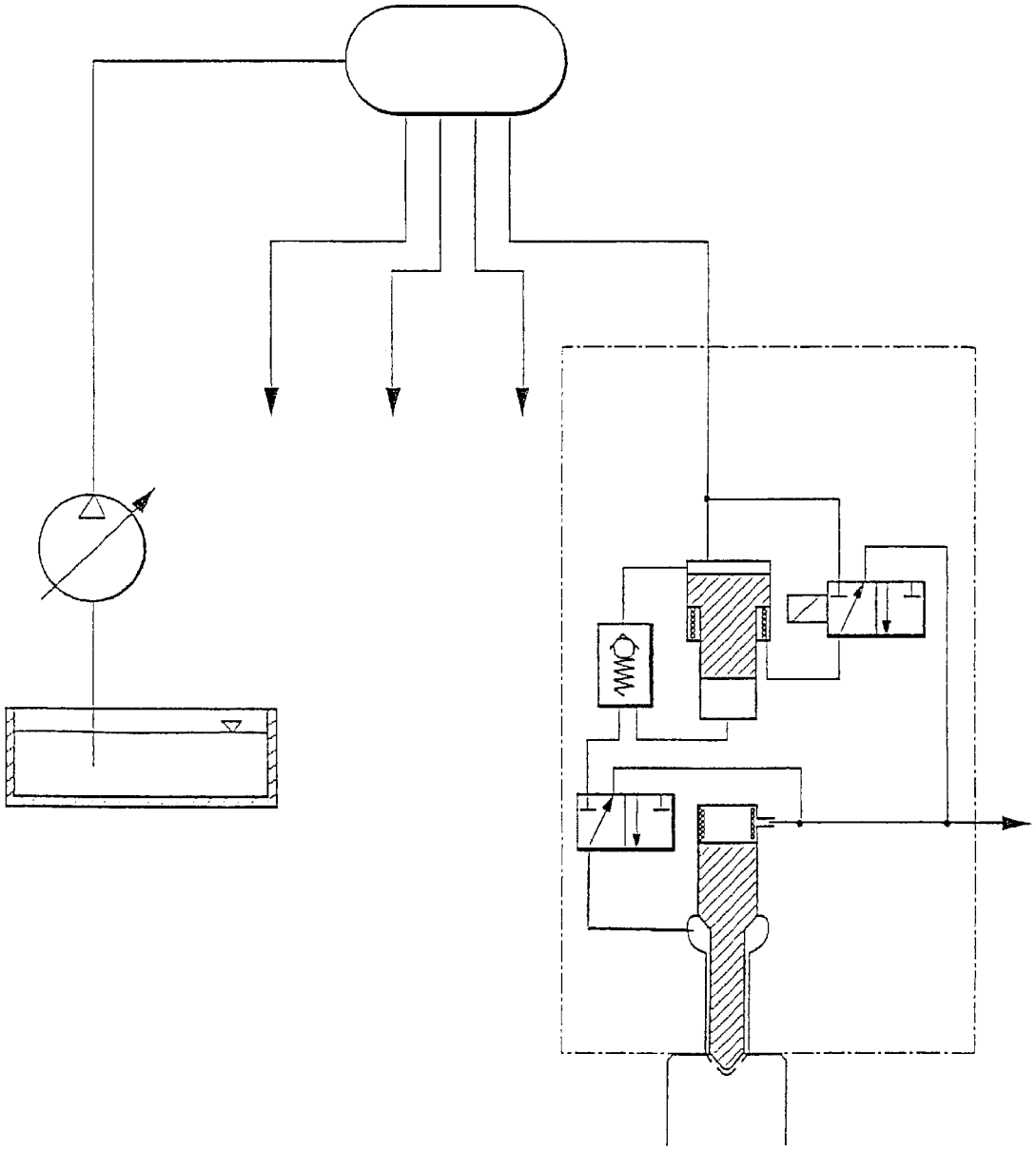

For controlling the pressure in the differential chamber, a 3/2-way valve can also be used. FIG. 6 shows the control via a 3/2-way valve for a valve member injection system. FIG. 7 shows the control via a 3/2-way valve for a pressure-controlled injection system.

Figure 8:
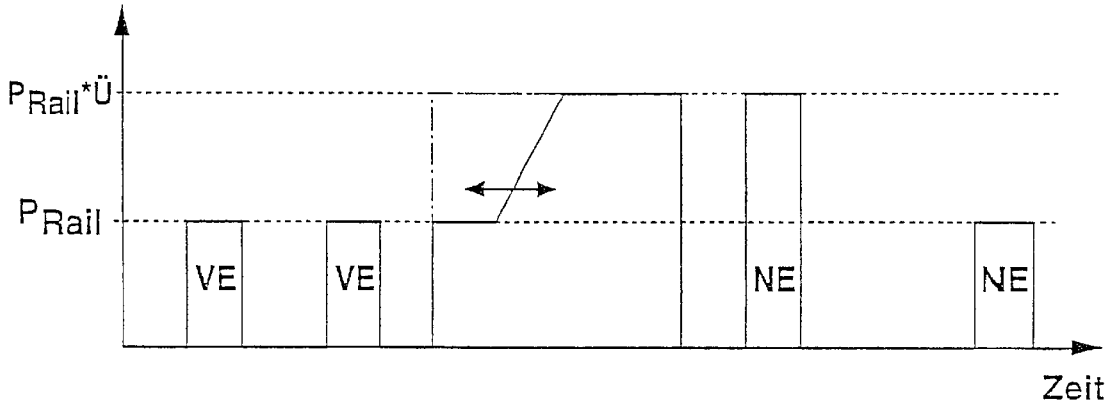
FIGS. 8 and 9, examples of possible schematic fuel injection pressure graphs.

For the stroke-controlled systems, a course of injection pressure in accordance with FIG. 8 is the result, beginning at the state of repose (the pressure step-up unit is deactivated and in its outset position). By switching the valve unit 27 and with a deactivated switching valve 10 of the pressure step-up unit, a preinjection at low, rail pressure is initiated at the beginning of the injection cycle via the bypass. By closure of the valve 27 (see FIG. 1), the preinjection is ended. By repeated switching, multiple preinjections are also possible. For the main injection, the valve unit 10 disposed upstream of the pressure step-up unit can be supplied with electric current, so that in the injector, an increased pressure, corresponding to the step-up ratio, results in the nozzle chamber and the control chamber. By opening of the valve 27, a main injection is now initiated (dot-dashed line). The termination of the main injection is then again effected by closure of the 2/2-way valve 27. If the pressure step-up unit is activated simultaneously with the valve 27, the result is an injection beginning at the rail pressure level, with a flank, rising in ramplike fashion, up to the stepped-up pressure (not shown in FIG. 8). If the addition of the pressure step-up unit is delayed still further, injection is initially done at rail pressure and then by addition of the pressure step-up unit, a bootlike course of injection upon activation of the pressure step-up unit occurs. The length of the high-pressure portion is dependent on the activation time of the pressure step-up unit. The main injection is terminated by closure of the valve 27. If the pressure step-up unit is deactivated before the closure of the valve 27, the result is a ramplike drop in the injection pressure down to the rail pressure level, in the manner known from pressure-controlled systems. For postinjection, a choice can be made between a high and a low injection pressure level. Thus a brief time after the main injection, either a postinjection at high pressure for soot reduction or a stepped-down postinjection at lesser injection pressure for exhaust gas posttreatment can be effected.

Figure 9:
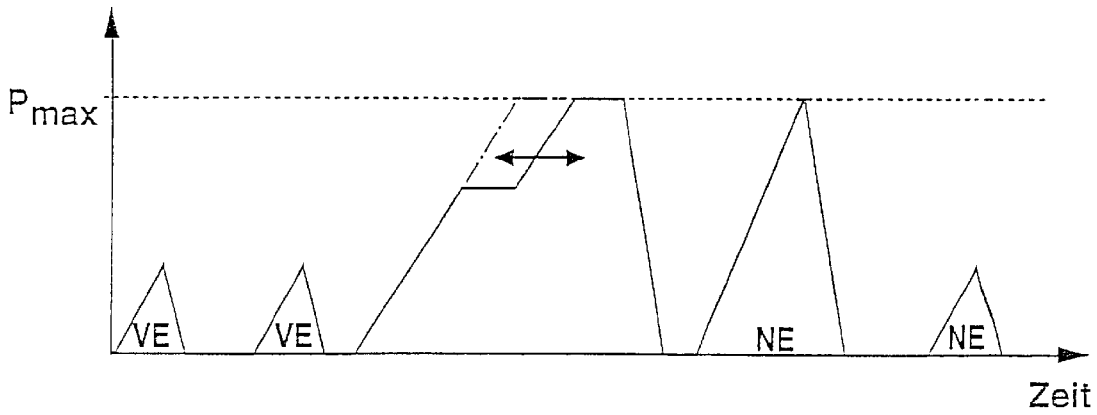

For the pressure-controlled systems, an injection pressure course shown in FIG. 9 results, beginning at the state of repose (the pressure step-up unit is deactivated and in the outset position). By switching of the valve unit 55 and with a deactivated switching valve of the pressure step-up unit, at the onset of the injection cycle a preinjection at low rail pressure is initiated via the bypass. By repeated switching, multiple preinjections are also possible. As a result of the pressure increase in the nozzle chamber, a ramplike course of injection pressure results in all the partial ranges of the injection. For the main injection, the valve unit 59 disposed upstream of the pressure step-up unit can be supplied with current simultaneously with the valve 55, resulting in a ramplike course of the injection pressure up to the stepped-up maximum pressure (dot-dashed line). The termination of the main injection is then again effected by closure of the valve 55. If the addition of the pressure step-up unit is delayed, then injection is first done at rail pressure, and by adding the pressure step-up unit, a bootlike course of injection results. The length of the high-pressure portion is dependent on the activation time of the pressure step-up unit. The main injection is terminated by closure of the valve 55, and as a result the injection pressure decreases again in ramplike fashion because of the relief of the nozzle chamber to the leakage pressure level, and the injection is terminated. For postinjection, a choice can be made between a high and a low injection pressure level. Thus, in a narrow interval after the main injection, either a postinjection at high pressure for soot reduction or a stepped-down postinjection at lesser injection pressure for exhaust gas posttreatment can be effected.

In addition to the aforementioned boot injections for both systems, it is conceivable to achieve a so-called rate-shaping nozzle, by means of a suitable form of the valve member (nozzle needle) and the shape of the nozzle chamber. This makes it possible to achieve a further pressure plateau either in the low-pressure part of the boot injection or in all injections. In turn, it is also conceivable to achieve a further shaping of the injection course in the high-pressure part of the injection, when the pressure step-up unit is in operation, by means of relief bores on the piston of the pressure step-up unit.

the foregoing relates to a preferred exemplary embodiments of the invention, it being understood that other variants and embodiments thereof are possible within the spirit and scope of the invention, the latter being defined by the appended claims.

List of Reference Numerals

1 Fuel injection system
2 Fuel pump
3 Fuel
4 Fuel injection system
5 Supply line
6 Pressure storage chamber
7 Pressure line
8 Injector
9 Pressure step-up unit
10 Valve unit
11 Check valve
12 Pressure means
12' Differential chamber
13 Leakage line
14 Pressure chamber
14' Primary chamber
15 Control chamber
16 Nozzle chamber
18 Valve member
19 Valve sealing face
20 Pressure line

21 Valve spring
22 Pressure piece
23 Face end
24 Throttle restriction
25 Pressure relief line
26 Throttle restriction
27 2/2-Way valve
28 Bypass line
50 Fuel injection system
51 Pressure storage chamber
52 Pressure step-up unit
53 Check valve
54 Bypass line
55 3/2-Way valve
56 Valve member
57 Valve spring
58 Pressure face
59 Valve unit
60 Injector
61 Fuel injection system
62 Valve unit for fuel metering
63 Valve unit for triggering pressure step-up
64 Injector
70 Pressure step-up unit
70' Primary chamber
71 Differential chamber
72 Piston
73 Spring
74 Pressure chamber
75 Throttle restriction
76 2/2-Way valve
77 Pressure storage chamber
78 Leakage line
79 2/2-Way valve

We claim:

1. A fuel injection system (1; 50; 61), having a pressure step-up unit (9; 52; 70) disposed between a pressure storage chamber (6; 51; 77) and a nozzle chamber (16), the pressure step-up unit having a pressure chamber (14; 37; 74) which communicates with the nozzle chamber (16) via a pressure line (20), and having a bypass line (28; 54) connected to the pressure storage chamber (6; 51; 77), wherein the bypass line (28; 54) communicates directly with the pressure line (20), wherein the step-up unit includes a differential chamber, and control of the pressure step-up unit (9) is effected hydraulically by imposition of pressure from the differential chamber.

2. The fuel injection system of claim 1, wherein the bypass line (28; 54) includes a check valve (11; 53).

3. The fuel injection system of claim 1, wherein the pressure step-up unit (9) is disposed inside an injector (8).

4. The fuel injection system of claim 2, wherein the pressure step-up unit (9) is disposed inside an injector (8).

5. The fuel injection system of claim 1, wherein the pressure step-up unit (9) is disposed outside an injector (8).

6. The fuel injection system of claim 2, wherein the pressure step-up unit (9) is disposed outside an injector (8).

7. The fuel injection system of claim 1, wherein the fuel injection system (50; 61) includes means for pressure-controlled injection of fuel.

8. The fuel injection system of claim 2, wherein the fuel injection system (50; 61) includes means for pressure-controlled injection of fuel.

9. The fuel injection system of one of claim 1, wherein the fuel injection system(1) includes means for stroke-controlled injection of fuel.

10. The fuel injection system of one of claim 2, wherein the fuel injection system(1) includes means for stroke-controlled injection of fuel.

11. The fuel injection system of claim 1, wherein the differential chamber can be made to communicate with a leakage line via a 2/2-way valve, and thereby communication exists from the differential chamber to the pressure storage chamber.

* * * * *